US008419208B2

(12) United States Patent
Pedersen et al.

(10) Patent No.: US 8,419,208 B2
(45) Date of Patent: Apr. 16, 2013

(54) ACTIVATABLE PACKAGED ARTICLES

(75) Inventors: Bradley D. Pedersen, Mississauga (CA); Kyle Jeffs, Mississauga (CA)

(73) Assignee: Tech 4 Kids, Inc. (CA)

( * ) Notice: Subject to any disclaimer, the term of this patent is extended or adjusted under 35 U.S.C. 154(b) by 0 days.

(21) Appl. No.: 13/253,034

(22) Filed: Oct. 4, 2011

(65) Prior Publication Data

US 2012/0085676 A1 Apr. 12, 2012

Related U.S. Application Data

(60) Provisional application No. 61/389,679, filed on Oct. 4, 2010.

(51) Int. Cl.
*F21L 4/04* (2006.01)

(52) U.S. Cl.
USPC ..... 362/205; 362/641; 206/525

(58) Field of Classification Search ..... 206/316.2, 206/775, 779, 525; 362/641–644, 205, 206, 362/208, 806
See application file for complete search history.

(56) References Cited

U.S. PATENT DOCUMENTS

| | | | | |
|---|---|---|---|---|
| 2,983,368 | A * | 5/1961 | Lugt, Jr. | 206/470 |
| 4,549,654 | A * | 10/1985 | Tiesman | 206/486 |
| 4,925,025 | A * | 5/1990 | Anten et al. | 206/335 |
| 6,311,837 | B1 * | 11/2001 | Blaustein et al. | 206/362.2 |
| 7,392,906 | B2 * | 7/2008 | Yu | 206/471 |
| 7,613,386 | B2 * | 11/2009 | Shimamura | 396/27 |
| 8,104,914 | B2 * | 1/2012 | Richmond | 362/183 |
| 2010/0315767 | A1 * | 12/2010 | Sanchez | 361/679.01 |

* cited by examiner

*Primary Examiner* — J. Gregory Pickett
*Assistant Examiner* — Raven Collins
(74) *Attorney, Agent, or Firm* — Adam K. Sacharoff

(57) ABSTRACT

A packaged article comprising in combination the article retained within packing having at least a portion by which the article may be visually observed; wherein the article has (i) operation means to effect operations of a desired function of the article; and (ii) control means by which the packing operation means is controlled and the packing allows of access to the control means to effect operation of said operation means to produce the desired function. As a result, the desired function of the article can be tested and seen by a potential purchaser even though the article is still sealed in its package.

2 Claims, 1 Drawing Sheet

ACTIVATABLE PACKAGED ARTICLES

FIELD OF THE INVENTION

This invention relates to sealed packaged articles, particularly packaged toys, which toys are activatable within the package so as to demonstrate the desired function of the article. This allows the potential purchaser to view the product, and particularly view lighting effects, or mechanical movement, or the like, even when the toy is packaged. As such, the invention allows customers, particularly parents, to view the operations of the article in a retail store, warehouse or the like, prior to making a purchase of the product.

BACKGROUND OF THE INVENTION

Sealed packaged articles, such as toys for use by children, are commonly purchased while still in the packaging, with the purchaser, typically a parent, having to rely on the description and instructions on the packaging showing how the toy would visually appear in operation. This situation can often lead to disappointment for the child once the toy has been purchased and the packaging removed, typically at home.

This can lead to the return of the product causing unnecessary expense to the supplier and retailer.

While the retailer can remove some product from its packaging to demonstrate use of the product, this can result in damage to the display item, and thus resulting in wastage, and potential loss of profits on the display item. There is clearly a need, where possible, for alleviating these issues by providing a means for the parent and child to view the desired result offered by the article, while the article is still packaged. This is particularly true in the use of a multi-functional toy, such as a combination nightlight and flashlight combination.

While it is known in the art to allow some limited access to the toy, and thus permit some activation of the toy while still in the package, this can lead to damage or other contamination of the product because at least part of the toy is accessible. As such, it would be preferred if the system of the present invention could totally enclosed the toy to be sold.

As such, to overcome these difficulties, it would be advantageous to provide a packaged product, and preferably, a packaged toy, that could be easily activated while still in the package, but which would be arranged so that the product's functionality was displayed, and preferably, without allowing contact with the toy itself. Further, it would be preferred if the toy could be activated using a simple, low cost device that would not add significant costs to the cost of the pre-existing packaging.

SUMMARY OF THE INVENTION

Accordingly, it is a principal advantage of the present invention to provide packaging, and most particularly packaging for a toy where the toy is not directly accessible to the public while in the package, but which is activatable while in the preferably closed package.

The advantages set out hereinabove, as well as other objects and goals inherent thereto, are at least partially or fully provided by the packaging of the present invention, as set out herein below.

Accordingly, in one aspect, the present invention provides a packaged article comprising in combination, said article which is retained within packing material but having at least a portion of which said article may be visually observed; wherein said article comprises (i) operation means to effect operations of a desired function of said article; and (ii) control means by which said packing operation means is controlled, and wherein said un-open packaged article provides access to said control means in order to effect operation of said operation means and thus produce said desired function.

The packing material preferably comprises a plastics material, and preferably a package material with at least part of the packaging being a clear, transparent package, by which said article may be visually observed. A preferred arrangement is a package with a cardboard backing, and a clear, plastic front cover which essentially surrounds the article to be sold.

Further, the packaging material prevents direct access to the article which is contained within the packaging, while allowing the user to have access to the control means.

Moreover, in a most preferred embodiment, the operation means comprises light generating means and the desired function is the production of light to illuminate an object or display, and preferably illuminate the article in whole or a component thereof. However, other operational means can be displayed, including activation of mechanical or other electrical functions.

As such, in alternative embodiments the operation means comprises means for effecting mechanical movement of the article or a component thereof, and the desired function is the mechanical movement of the article or a component thereof. Other uses might be for the generation of sound, or the generation of an electro-mechanic effect, such as operation of a toy projector, or the like.

Preferably, the control means comprises a displacable activatable member, such as, for example, an on-off switch, button or the like. A preferred control means is a contact switch which is normally in contact with the operation means.

In one embodiment, the packaging provides a suitably located aperture in which the operation means is located, so that the user has direct or indirect access to the operation means. As such, the operation means can be easily accessed, and thus, the control means can be activated. Since the operation means is located within the aperture, the inadvertent activation of the operation means, is minimized. As such, in a preferred embodiment, the operation means is preferably located within the aperture but which is still accessible so as to effect activation and/or deactivation of the operation means.

In one preferred embodiment, the packaging comprises a biasing means operatively adjacent the operation means, so that the article is positioned in a manner that: (i) the operation means is normally in abutment with the control means; and (ii) the operation means is operably releasable from said control means, by movement away from said control means, and thus out of abutment with said control means, and thus effect activation of the control means.

Preferably, the biasing means comprises a resiliently flexible member manually operable through the aperture. Most preferably, the biasing means is provided by a plastic member formed from the same material as the packaging material itself.

Access to operation means could therefore be provided by an opening in the sales box, an opening in a blister pack, a flexible film over a test button that allowed it to be pressed, or the like.

In alternative embodiments to some of the preferred embodiments defined hereinabove, the control means comprises biasing means in abutment with the displacable activatable member.

DETAILED DESCRIPTION OF THE INVENTION

In the present application, the term "package" refers to any suitable container, which can include cardboard boxes, metal enclosures, or the like, but most preferably is a plastic container, and most preferably, a clear plastic container. The package is also preferably blow moulded, vacuum formed, or otherwise formed to a suitable shape, such as in a "blister pack", in order to hold the toy. Numerous examples of this type of plastic packaging are known, and the general production techniques for these types of packaging materials is outside of the scope of this invention.

Further, while the word "toy" is used throughout the present application, it is clear that the present invention has utility outside of the toy area, and can be modified for use with any type of device that might be activable by a potential user, while the product is still in the package. The skilled artisan will be aware that the packaging of the present invention can be used in a wide variety of applications. However, the present invention is of particular utility when applied to the toy market segment.

Unless otherwise specifically noted, all of the features described herein may be combined with any of the above aspects, in any combination.

BRIEF DESCRIPTION OF THE DRAWINGS

Embodiments of this invention will now be described by way of example only in association with the accompanying drawings in which.

DETAILED DESCRIPTION OF THE PREFERRED EMBODIMENTS

Figure 1:
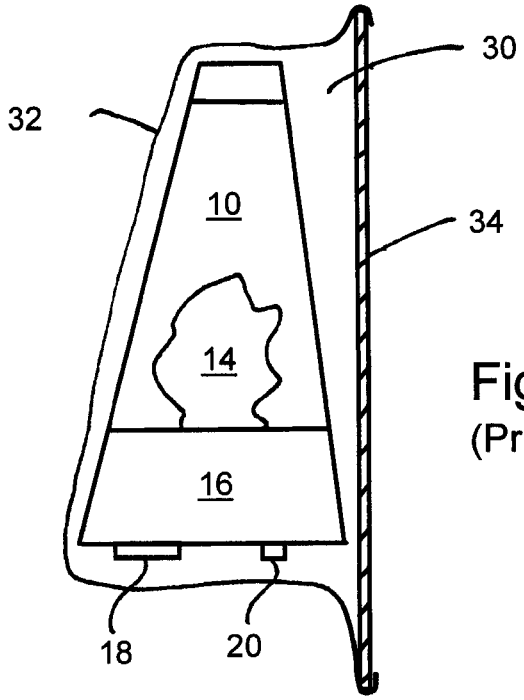
Figure 1 (Prior Art)
FIG. 1 is a diagrammatic vertical front sectional view of a toy according to the prior art.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Referring to FIG. 1, a side view of a combined night light-flash light article 10 is shown within a prior art packaging system 30. Packaging system 30 includes packaging formed of a clear, rigid plastic film 32 affixed to background cardboard backing 34 bearing descriptive text.

Article 10 has a light reflecting shaped plastics member 14 positioned on a base 16 above a first LED (not shown). At the bottom of base 16 is a lens 18, which has a second LED light source (not shown). A switch 20 protrudes through base 16, and is normally closed when article 10 is standing on a suitable surface, such as a night table, (not shown), after it has been removed from packaging system 30. In normal operation, when article 10 has been removed from packaging system 30, and placed on a surface, switch 20 is in its closed position. When article 10 is lifted from the surface, switch 20 is opened causing second LED to be activated, and thus provide light through lens 18. As such, the article 10 acts as a flashlight.

When returned to the surface, switch 20 is again closed, and this contact de-activates the second LED. However, first LED now illuminates and shines light into plastics member 14 so as to act as a nightlight. After a pre-set time period, first LED will cease to be illuminated, and the article 10 returns to its off position.

It will be noted though, that the specific functionality of article 10 is not of importance. It is of primary importance however, that the functionality of article 10 (whatever it might be) can be demonstrated while article 10 is in the package.

In FIG. 1, article 10 is shown within a prior art packaging system 30, and it is difficult within this system 30 to show how article 10 operates without allowing movement of article 10, or the like. Moreover, for shipping and storage, switch 20 must remain in the closed position so as to conserve battery life, but it is difficult to overcome this requirement when the article is viewed by the consumer without allowing the consumer to open the package or have direct access to the article. As a result, it is not easy for the consumer to fully appreciate the functionality of article 10.

Figure 2:
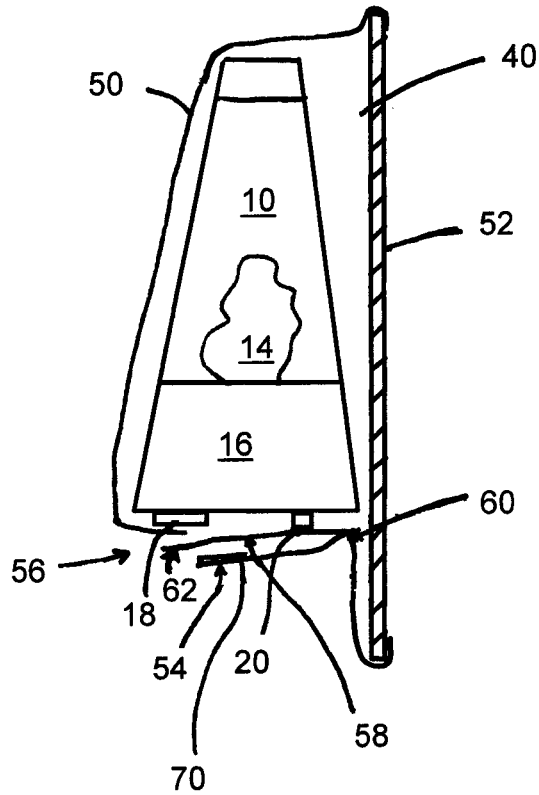
FIG. 2 is a diagrammatic vertical front sectional view of a packaged toy shown in FIG. 1, as retained within packaging, according to the invention.

FIG. 2 shows the same article 10 within a packaging system 40, according to the present invention. As in FIG. 1, packaging system 40 includes packaging formed of a clear, rigid plastic film 50 affixed to background cardboard backing 52 bearing descriptive text. Rigid film 50 is suitably shaped as to essentially follow the contour of most of article 10. Rigid film 50 has a packaging base 54 and an aperture 56 in film 50 which is adjacent switch 20.

A flexible strip 58 made of the same plastic film as that of film 50, is provided which is retained at one end 60 to packaging base 54 while the other end 62 of strip 58 is located within aperture 56. At end 60, a living hinge is formed of the plastic material from film 50, and is normally biased so that strip 58 will hold switch 20 in its closed position. As a result, strip 58 is integral with film 50.

However, end 62 is accessible to allow operable manipulation of strip 58 by a finger. Strip 58 in its resting state is biased so as to abut button 20 and thus simulates having article 10 resting on a table, or the like, by having resiliently flexible strip 58 act against button 20. However, downward manipulation of strip 58 at its end 62 by finger action moves strip 58 out of abutment contact with button 20 and thus effects activation of the second LED. This simulates the user picking up article 10 from a table top.

Release of strip 58 causes it to return to its normal position, and once again, abut button 20. This simulates the user returning article 10 to the table top surface, and thus, de-actives second LED, and initiates the nightlight feature of the article, as previously described. Thus, by simply moving strip 58, the purchaser can view the full functionality of article 10 without removal of the product from the package, and thus without contacting the article itself.

As a result, the user is able to view the fully functionality of article 10 without making any contact with article 10. Moreover, should the user wish to purchase the article, they can be assured that previous potential purchasers have not had direct access to the article.

In a further preferment, packaging base 54 has an embedded aluminum strip 70 to enhance light reflection from the second LED, and thus, provide an enhanced visual appearance of this function of article 10.

In an alternative arrangement, article 10 is a nightlight and flashlight combination, wherein both the first and second LED lights are activated and are illuminated at the same time. As such, movement of strip 58 will cause both LEDs to be activated at the same time.

Thus, it is apparent that there has been provided, in accordance with the present invention, a toy packaging combination, which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps. Further, the invention illustratively disclosed herein suitably may be practiced in the absence of any element which is not specifically disclosed herein.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

The invention claimed is:

1. A packaged article including in combination packaging material through which at least a portion of an article retained within packing material is visually observed, the combination further comprising:

said article having:

a light source and a lens and said light source being configured to illuminate light out of said lens, and a switch normally biased in an outwardly configuration is in communication with the light source and configured to de-activate said light source when the switch is pressed inwardly and wherein the light source is normally configured to illuminate light out of said lens when the switch is released; and said packaging material having:

a base with an aperture positioned in the base adjacent said switch, a flexible strip of material having one end retained to the base adjacent said aperture at a hinge and extending over said aperture, said hinge configured to bias at least a portion of the flexible strip of material against the switch such that the switch in pressed inwardly de-activating said light source, and said flexible strip of material having another end positioned away from said hinge and configured to be moved away from said base sufficiently such that said portion of the flexible strip of material is moved away from said switch to cause said switch to bias outwardly causing the light source to illuminate light out of said lens.

2. The combination of claim 1 further comprising an aluminum strip of material positioned in the packaging base configured to reflect light illuminating out of said lens.

* * * * *